United States Patent [19]

Greenwald

[11] 4,164,231

[45] Aug. 14, 1979

[54] APPARATUS FOR CONTROLLING THE LENGTH OF CIGARETTE TO BE SMOKED

[76] Inventor: Jonas Greenwald, 1 Prospect Park SW., Brooklyn, N.Y. 11215

[21] Appl. No.: 815,563

[22] Filed: Jul. 14, 1977

[51] Int. Cl.[2] ..... A24F 13/02

[52] U.S. Cl. ..... 131/192

[58] Field of Search ..... 131/187, 192, 182, 181, 131/188–190, 263

[56] References Cited

U.S. PATENT DOCUMENTS

| | | | |
|---|---|---|---|
| 216,160 | 6/1879 | Dubois | 131/187 |
| 2,669,238 | 2/1954 | Rawlings | 131/187 X |
| 2,820,462 | 1/1958 | Fleischer | 131/187 UX |
| 3,370,592 | 2/1968 | Schultz et al. | 131/263 X |
| 4,015,610 | 4/1977 | Pasche | 131/263 X |

*Primary Examiner*—Stephen C. Pellegrino

*Attorney, Agent, or Firm*—Peter L. Berger

[57] ABSTRACT

An integral cigarette holder and sheath or cover for a cigarette is disclosed in which the sheath or cover is formed of telescoped members. The cigarette is inserted within the holder and the telescoped cover is extended to permit a portion of the cigarette to be smoked. As the cigarette is smoked down to the distal end of the telescoped members, insufficient oxygen is present to permit the continued burning and smoking of the cigarette.

6 Claims, 4 Drawing Figures

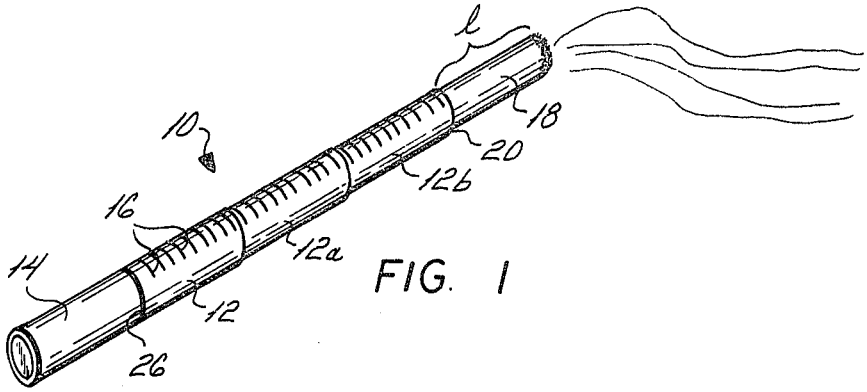
FIG. 1
FIG. 2
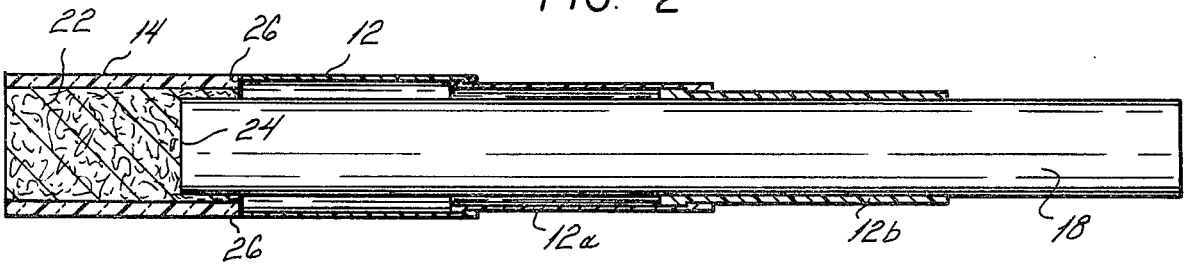
FIG. 3
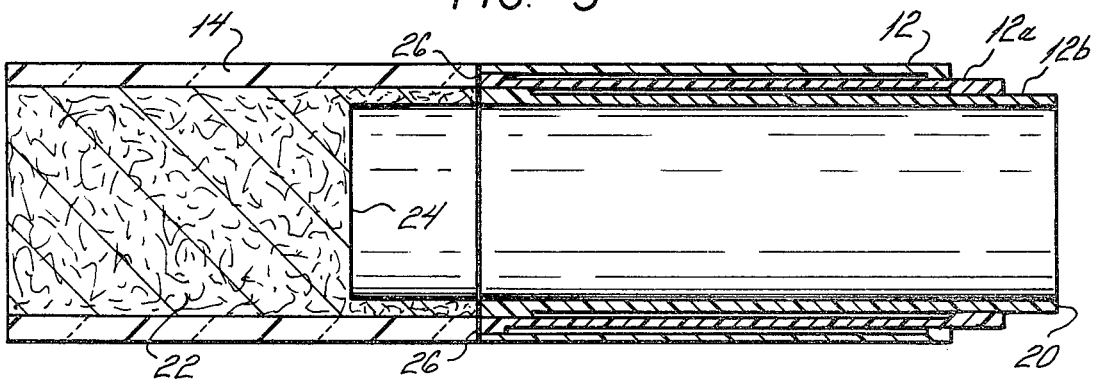
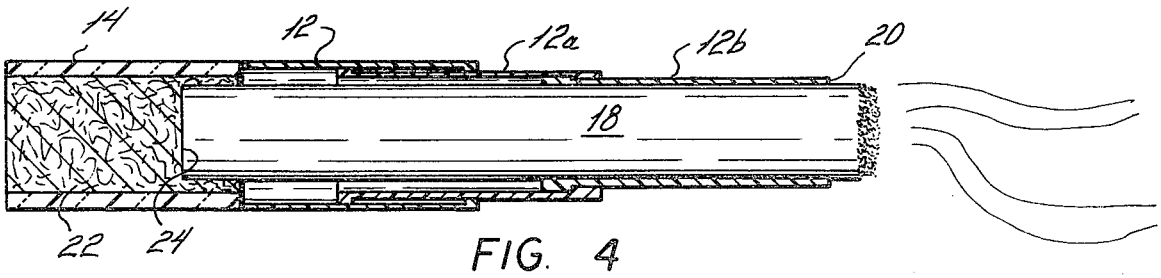
FIG. 4

APPARATUS FOR CONTROLLING THE LENGTH OF CIGARETTE TO BE SMOKED

PRIOR ART STATEMENT

A prior art search was conducted and the following list of patents was discovered:

| Pat. No. | Inventor |
|---|---|
| 3,771,535 | Mezoff |
| 3,583,406 | Soyars |
| 2,667,170 | Lebert |
| 908,809 | Singley |
| 711,691 | Barger |
| 1,254,307 | Boyadjian |
| 895,568 | Leu |
| 291,115 | Webb |
| 1,165,000 | Dula |
| 2,956,569 | Adams |
| 1,816,139 | Aster |
| 3,771,534 | Kuehne |
| 3,921,645 | Hagman |
| 124,545 | Chase |
| 1,023,288 | Wolleson |
| 1,121,253 | Ivory |
| 1,532,732 | Collins |
| 1,805,228 | Abbott |

None of these patents is relevant to nor anticipatory of the instant invention, and therefore, none of these patents is being submitted with this prior art statement. Applicant is unaware of any prior art which is closer to his invention than those patents listed above.

BACKGROUND OF THE INVENTION

This invention is related to an apparatus for limiting the amount of cigarette smoked by the smoker, and more particularly, is such a device which is readily and easily usable.

Numerous attempts are made by smokers to cut down on the amount of smoke they ingest. Many of the systems are related to training the smoker to smoke less, hypnotism, and other types of behavior modification techniques. Some are successful, while others are not.

Many smokers consistently smoke very much less than a full cigarette, and a large portion of the tobacco in the cigarette is wasted. There is no convenient apparatus for holding and saving the unsmoked tobacco, and, therefore, much waste, as described above, takes place.

An object of this invention is to provide an apparatus for controllably smoking a predetermined length of a cigarette, yet permitting the remaining length of the cigarette to be smoked at subsequent times.

Another object of this invention is to provide such an apparatus which is easy to use, inexpensive, and simple to manufacture.

Yet another object of this invention is to provide such an apparatus which may materially reduce the amount of cigarette consumption, yet permit the smoker to continue smoking.

Another object of this invention to to provide such an apparatus which reduces the waste presently encountered by the normal disposal of unused cigarette tobacco.

Other objects, advantages and features of this invention will become more apparent from the following description.

SUMMARY OF THE INVENTION

In accordance with the principles of this invention, the above objects are accomplished by providing an apparatus for controlling the length of the cigarette to be smoked, which comprises a generally cylindrical sheath comprising concentric telescoped members, with a cigarette to be smoked inserted within the sheath. The telescoped members are opened to a predetermined length, which leaves exposed the amount of cigarette desired to be smoked. As the end of the cigarette reaches the distal end of the telescoped members, insufficient oxygen is available to permit the cigarette to be continued to be smoked, and it will be extinguished naturally. The concentric telescoped members may be provided with gradations so that the user can predetermine the length of cigarette he wishes to smoke.

The sheath may be integrally formed with a mouthpiece which may be a filter-type mechanism adapted for easy removal and replacement.

BRIEF DESCRIPTION OF THE DRAWINGS

FIG. 1 is a perspective of an embodiment of my invention illustrating the mouthpiece and telescoped members hugging a conventional cigarette.

FIG. 2 is a sectional view illustrating the cigarette held within the sheath.

FIG. 3 is a view similar to FIG. 2 with the telescoped members fully closed.

FIG. 4 is a view similar to FIG. 2 with the telescoped members partially opened, representing an intermediate stage between FIGS. 2 and 3.

DETAILED DESCRIPTION

Referring now to the Figures, there is shown in FIG. 1 a perspective view of my sheath or holder 10, formed of telescoped members 12, 12*a*, and 12*b* to which a mouthpiece 14 is removably secured. The telescoped members are provided with scale gradations 16 along their length to indicate the length of cigarette desired to be smoked. As may be seen from FIG. 1, a standard cigarette 18 is held within the holder or sheath 10 and extends beyond the distal end 20 of the sheath, when it is extended. The amount of cigarette represented by 1 extending beyond the distal end of the sheath represents that amount of tobacco which will be smoked. As the cigarette burns down to the distal end 20, the amount of oxygen available to permit further smoking decreases and becomes so insignificant that the cigarette naturally becomes extinguished.

Referring now to FIGS. 2–4 there is shown the sheath or the holder of my invention in varying stages, with FIG. 2 illustrating the fully opened telescoping members 12, 12*a* and 12*b*. FIG. 3 illustrates the telescoping members being closed so that telescope member 12*b* fits within telescope member 12*a* which fits within telescope member 12. Of course, the telescope members are generally concentric and are adapted to closely hug and conform to the cigarette so as to minimize the amount of extra tobacco smoked after the end of the cigarette reaches the distal end 20 of the sheath.

In another aspect of this invention, the mouthpiece 14 may be formed with filter members 22 therein, the filter members being housing within the mouthpiece 14 formed of a clear plastic material so that as the filter means 22 traps more impurities, the smoker will become readily aware of the amount of impurities passing through to his body. It is believed that this will further serve induce the smoker to cut down or stop smoking. As illustrated in FIGS. 2–4, the cigarette is fitted within a receptacle portion 24 integrally formed with the mouthpiece 22 in the fixed end of the sheath and is adapted to firmly receive and hold the end of the cigarette placed therein.

The mouthpiece 14 may be removably secured to sheath 10 as at 26 at suitable adhesive or friction connecting means.

In operation, the cigarette 18 is placed within the sheath and the user adjusts the telescoping members to expose a predetermined amount of cigarette to be smoked. After that amount of cigarette is smoked, it will naturally be extinguished. The next time the smoker wishes to smoke, he merely moves back the telescope members a predetermined number of gradations to then expose another length of cigarette to be smoked. In this manner, the smoker controls the amount of cigarette smoking and does not waste the unused tobacco.

Although this invention has been disclosed with the embodiment illustrated above, other ways may be devised by those or ordinary skill in the art to practice the invention in accordance with the principles taught above, without departing from the scope of the invention.

What is claimed is:

1. Apparatus for controlling the length of a cigarette to be smoked comprising a generally cylindrical sheath comprising movable concentric telescoped members adapted to closely fit aroud a standard cigarette, said sheath having a fixed end and a telescoped end, a mouthpiece attached to the fixed end of said sheath, receptable means fixedly formed within said sheath and mouthpiece for receiving and holding said cigarette within said sheath, and means for adjustably fixing the length of said sheath by moving the telescoped end to expose a controlled length of cigarette to be smoked.

2. Apparatus as set forth in claim 1, wherein said telescoped members includes scale gradations to indicate the length of cigarette being smoked.

3. Apparatus as set forth in claim 1, wherein said mouthpiece comprises filter means to further filter the smoke reaching the smoker.

4. Apparatus as set forth in claim 1, wherein said receptable means is integrally formed within said mouthpiece.

5. Apparatus as set forth in claim 1, wherein said filter means is removably secured to said sheath to facilitate replacement.

6. Apparatus as set forth in claim 4, wherein said filter means comprises light colored trap elements and a clear plastic housing to viewably display the amount of impurities trapped in said filter.

* * * * *